United States Patent [19]

Caputo et al.

[11] Patent Number: 4,638,515

[45] Date of Patent: Jan. 27, 1987

[54] TOILET HOOK

[76] Inventors: Anthony Caputo; Gary P. Culter, both of 2273 Dundas Street West, Mississauga, Ontario, Canada, L5K 1R6

[21] Appl. No.: 813,228

[22] Filed: Dec. 24, 1985

[51] Int. Cl.[4] ..... A47K 13/00; A47K 17/00

[52] U.S. Cl. ..... 4/661; 4/235; 4/253; 292/254

[58] Field of Search ..... 4/235, 661, 253, 251, 4/DIG. 15; 292/254

[56] References Cited

U.S. PATENT DOCUMENTS

| | | | |
|---|---|---|---|
| 542,633 | 7/1895 | Emery | 4/235 |
| 903,596 | 11/1908 | Martin et al. | 4/235 |
| 2,305,147 | 12/1942 | Deal | 4/235 |

*Primary Examiner*—Henry K. Artis

[57] ABSTRACT

An apparatus for releasably maintaining a toilet seat in a generally vertical position comprises a mounting member adapted to be secured to the toilet tank in a position to engage a toilet seat and maintain the same when moved to a general vertical orientation. According to one embodiment, a hook is forced upwardly due to movement of the toilet seat to the vertical position, and is positioned outwardly at the tank to allow the seat and toilet cover to move past the hook which then maintains these in the vertical position. Manual movement of the toilet seat past the hook will cause the hook to move upwardly to thereby allow the toilet seat to move therepast. As the hook starts to maintain the toilet seat, the toilet cover is also maintained by the hook as it cannot move past the toilet seat.

8 Claims, 16 Drawing Figures

FIG. 5.
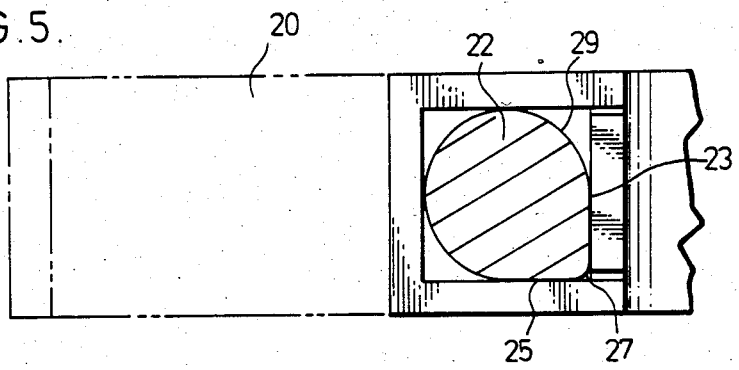
FIG. 6.
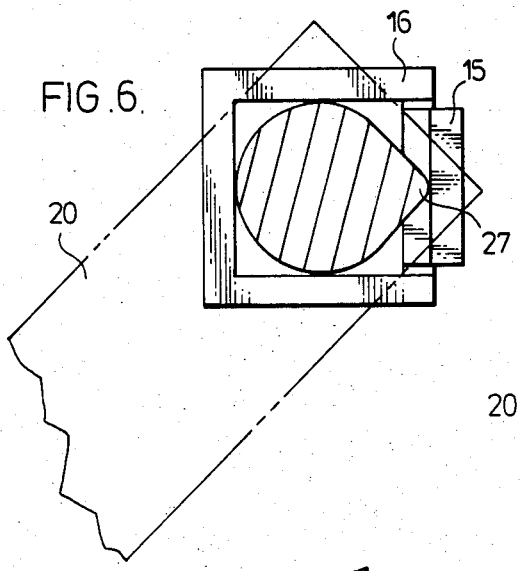
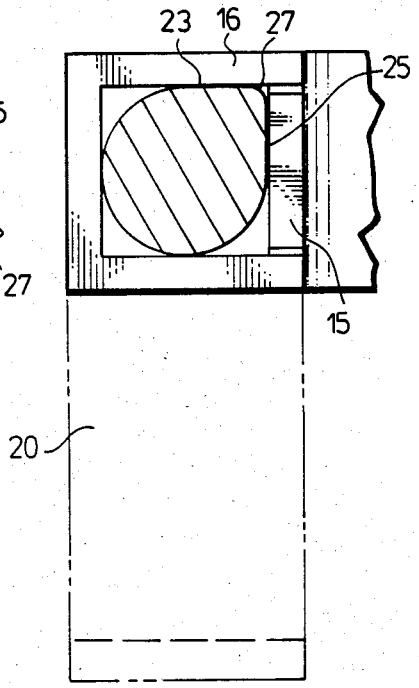
FIG. 7.
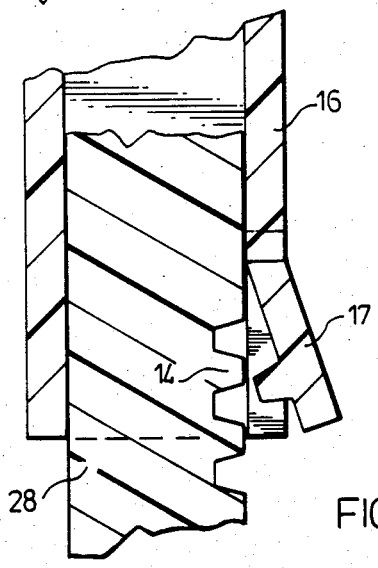
FIG. 8.

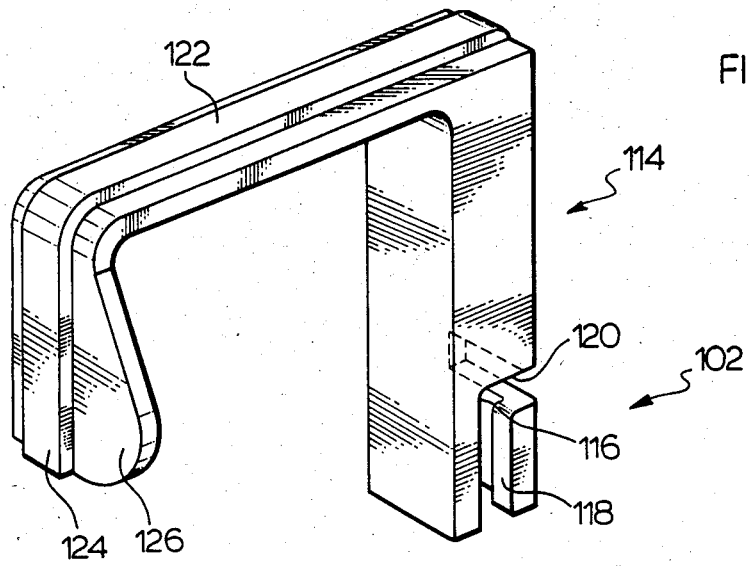
FIG. 12.
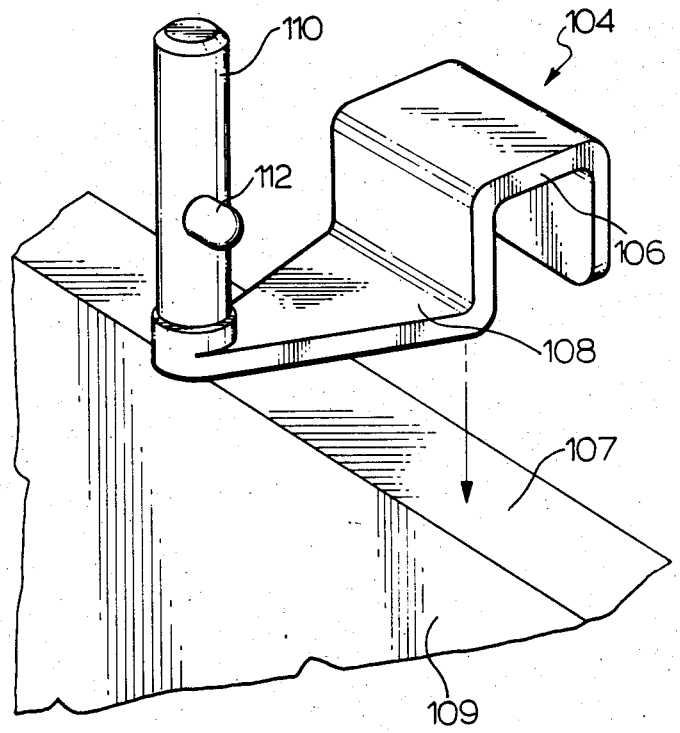

TOILET HOOK

BACKGROUND OF THE INVENTION

The present invention relates to toilet accessories and in particular to an apparatus for releasably maintaining a toilet seat and toilet cover in a vertical position.

Fabric covers are now available for toilet seats, and have gained wide acceptance as these fabric covers can be coloured coordinated with other bathroom accessories. The covers tend to be fairly plush and as such, spaces the toilet cover closer to the vertical position, when it is resting against the toilet tank wall. This in itself, is not a problem as the toilet cover has moved past the vertical position and is held against the tank by gravity, however, when one raises the toilet seat to the generally vertical position, the toilet seat, in many cases, cannot move past or appreciably past the vertical position, and as such tends to fall forward to the position on the toilet bowl. The fabric covers have, therefore, rendered the designed operation of the toilet seat ineffective as the spacing of the toilet cover from the tank wall due to the thickness of the fabric cover applied thereto is such that the toilet seat cannot be maintained or at least has the tendency to return to the generally horizontal position.

According to the present invention, a toilet seat hook is taught which maintains the toilet seat in a generally vertical position when moved to such a position, thereby overcoming the problems associated with the use of fabric covers. The apparatus comprises mounting means for securing the apparatus to a toilet and means for selectively contacting and maintaining this toilet seat in the vertical position when moved thereto.

According to a preferred aspect of the invention, the apparatus has means for vertical adjustment to accomodate toilet seats of various dimensions and also allows generally repositioning of a portion of the apparatus when it is not required. According to a further aspect of the invention, the apparatus includes a hook engaging portion, which projects forwardly of a toilet tank wall when secured thereto and is rotatable horizontally to a non-use position.

BRIEF DESCRIPTION OF THE DRAWINGS

Preferred embodiments of the invention are shown in the drawings wherein;

FIG. 5 is a sectional view through the lug 22 along line 55 of FIG. 3 and also showing a sectional view through the collar along line 6—6 of FIG. 3;

FIG. 6 is a view similar to FIG. 5 with the hook portion being moved to a non-engaged position; and FIG. 7 is a view similar to FIG. 5 with the hook moved to the non-use position;

FIG. 8 is a partial sectional view showing vertical adjustability of the toilet hook;

FIG. 12 is a perspective exploded view of a modified toilet hook;

DETAILED DESCRIPTION OF THE PREFERRED EMBODIMENTS

Figure 1:
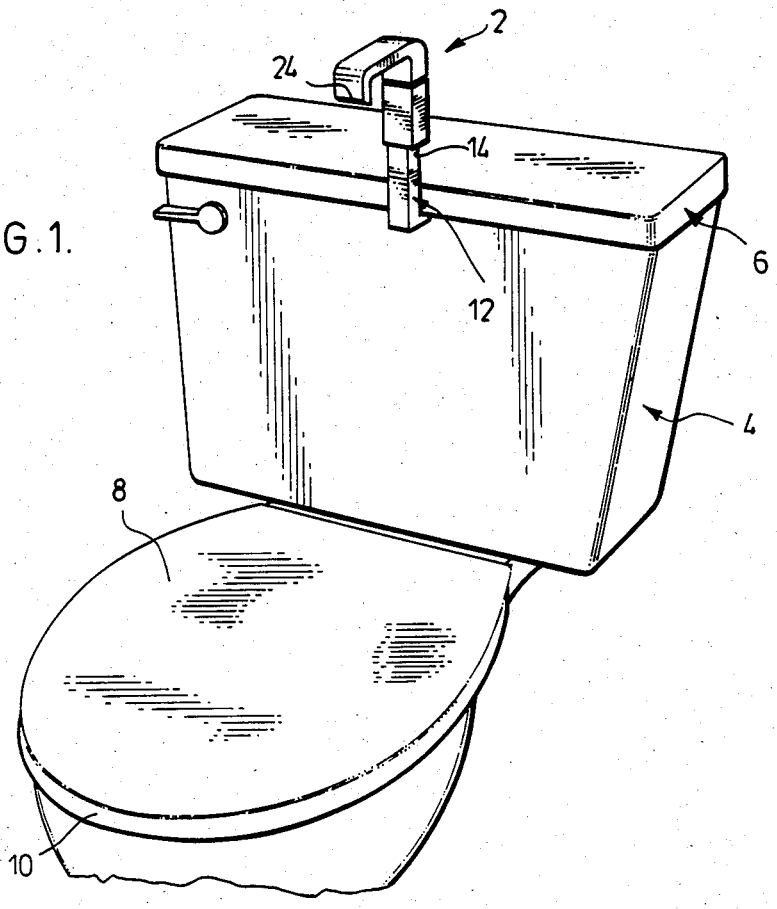
FIG. 1 is a partial perspective view of a toilet tank having the toilet hook secured thereto.
Figure 2:
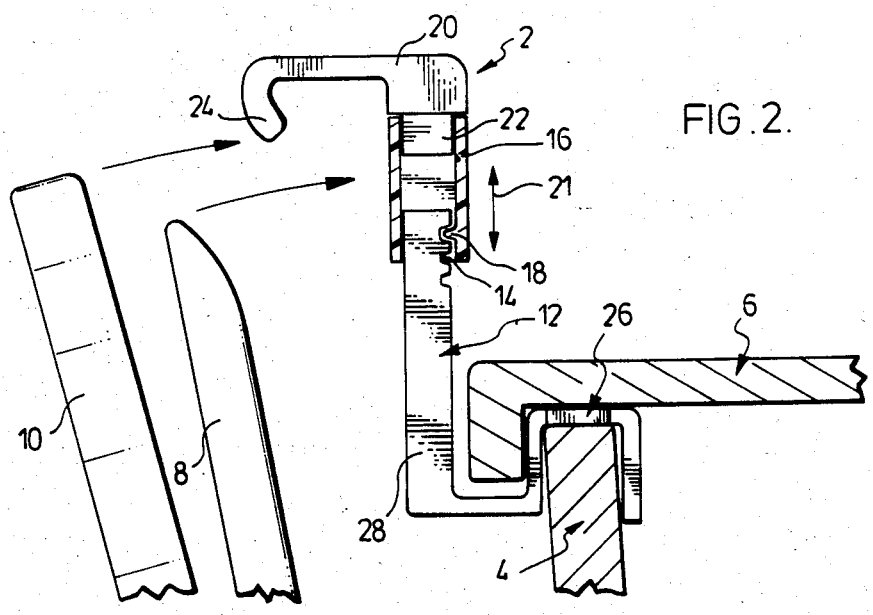
FIG. 2 is a partial cross section showing securing of the toilet hook to a toilet tank.

The toilet hook apparatus 2 as shown in FIGS. 1 and 2 is secured intermediate the upper wall of the toilet tank 4 and the toilet tank cover 6, with the seat engaging projection 24 positioned forward of, and above, the forward edge of the tank cover and tank. The apparatus 2 is adapted to maintain, in the vertical position, the toilet cover 8, and the toilet seat 10 and in particular the toilet seat 10. The toilet cover and toilet seat are of the conventional type being hinged adjacent the base of the toilet tank 4 and moveable to a generally vertical position and held in the vertical position by gravity. This arrangement is defeated when a cover is applied to the toilet cover 8, whereby the toilet seat 10 is not held in the vertical position by gravity as it cannot move past the vertical position due to the thickness of the cover. Correction of this problem is difficult and, therefore, the apparatus 2 provides a simple solution for maintaining the seat 10 in the vertical position.

The toilet hook apparatus 2, includes a base portion 12 having a toothed surface 14 which lockingly engages with collar 16 via the locking lug 18. The lug 18 may be camed outwardly to allow changing of the vertical position of the collar 16 for adjusting the apparatus in accordance with the dimensions of the seat 10. This vertical adjustment is indicatd by arrow 21. The hook portion 20 is maintained by the collar 16 via the lug 22 of the hook portion being received within the collar 16. The hook portion also has a seat engaging projection 24 downwardly disposed which is camed upwardly as the toilet seat 10 moves therepast and into the recess defined between the projection 24 and the collar 16.

The base 12 includes an upright portion 28 for positioning of the collar and hook above the tank cover 6 which has a channel portion 26 for mounting of the base 12 to the tank wall 4, at the upper edge thereof and intermediate the toilet tank cover 6. As more clearly shown in FIG. 3, mounting of the base 12 is accomplished by having the rear portion thereof having a channel 26 for snuggly engaging the tank wall with the channel having an area 32 crossing the top of the tank and held between the tank cover and the tank wall. Therefore, when secured, the base 12 is not rotatable in the vertical plane. The top wall 32 may be of additional length which assist in maintaining the upright 28 properly disposed. The channel 26 is defined by the back wall 30, the top wall 32 and the front wall 34 and a further channel 36 may be provided between the front wall 34 and the upright 28 for receiving the lip of the toilet tank cover. This channel 36 in some cases, may be quite shallow depending upon the design of the toilet tank cover to which the toilet hook is to be applied.

Figure 3:
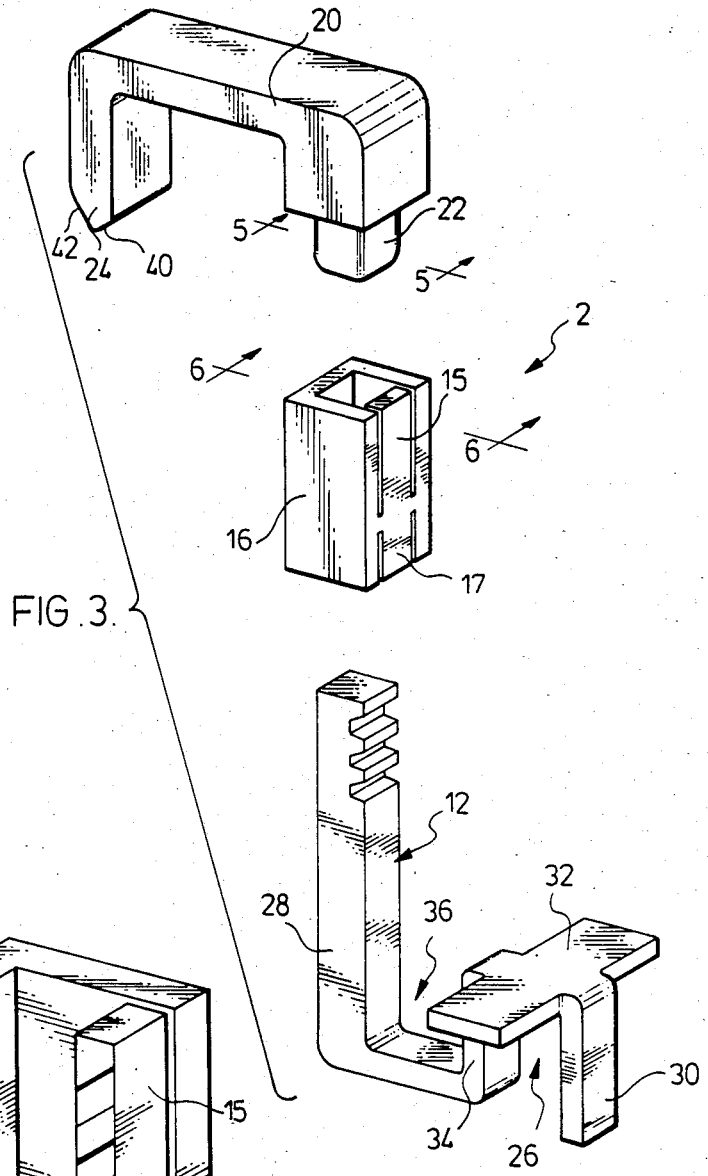
FIG. 3 is a exploded perspective view of the toilet hook apparatus.

The seat engaging projection 24 preferrably has an exterior surface which provides easy caming of the hook portion upwardly by movement of the seat cover 10 therepast. As shown in FIG. 3, cam surfaces 40 and 42 have been provided. It can be appreciated that this apparatus can be made of an injection moulded plastic which inherently has an appreciable amount of elastic defermation and, therefore, precision cam surfaces will not be required. Obviously the seat engaging projection 24 in its preferred embodiment will facilitate moving of the seat cover 10 therepast to be held in the vertical position or to be moved to the horizontal position, whereby engagement of the seat 10 is automatically accomplished. This arrangement allows the apparatus to remain in its operating position, whereby the person only need to raise the seat or lower the seat without adjusting the apparatus 2.

Figure 4:
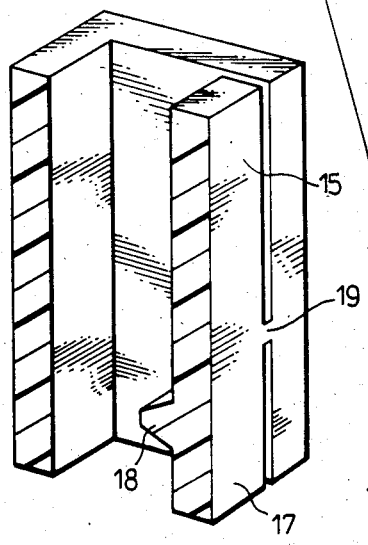
FIG. 4 is a perspctive vertical cut-away of the collar which accomodates vertical adjustability and movement of the hook portion to a non-use position.

FIG. 4 is a cut-away through the collar 16 and shows the rear wall of the collar having biased walls 15 and 17 which can provide a hinge-type action about the securing portion 19. Wall 17 can move outwardly as generally shown in FIG. 8 to allow vertical adjustment of the collar relative to the upright 28 and wall 15 may move outwardly as shown in FIG. 6 caused by projection 27 moving from the position shown in FIG. 5 to the non-used position shown in FIG. 7. In the position of the hook in FIG. 6, the hook is intermediate the in-use position shown in FIG. 5 and the non-use position of FIG. 7. The lug 22 includes stop faces 25 and 23 for cooperating with the interior walls of the collar 16, whereby the hook is movable from the in-use position of FIG. 5 to the non-use position of FIG. 7 by horizontally rotating the hook 20 about the vertical axis of the upright member 28, with the hook being maintained in either of these positions due to the cooperating engagement of walls 27 and 25 with the interior walls of the collar and the biased wall 15 of the collar.

Figure 9:
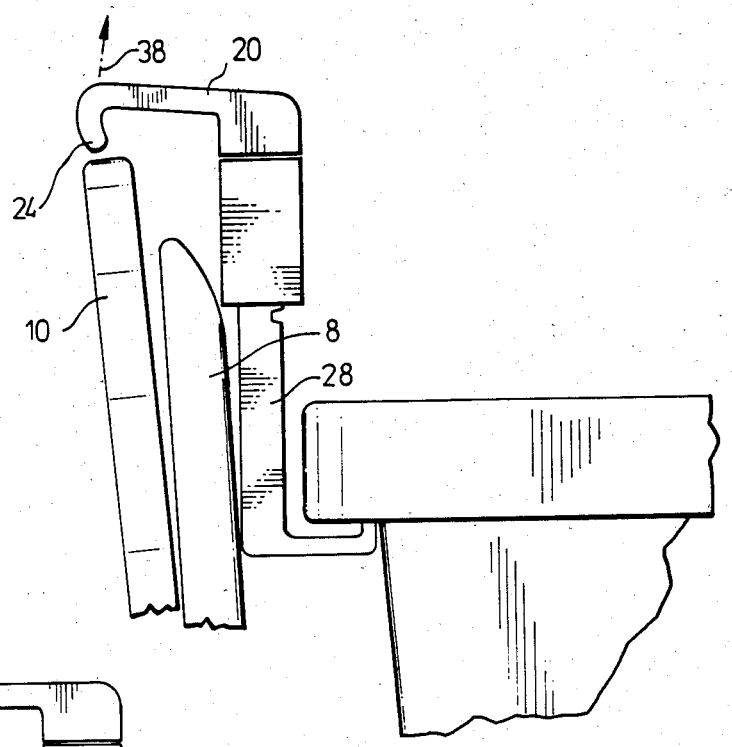
FIGS. 9 and 10 show the toilet hook engaging and retaining a toilet seat.
Figure 10:
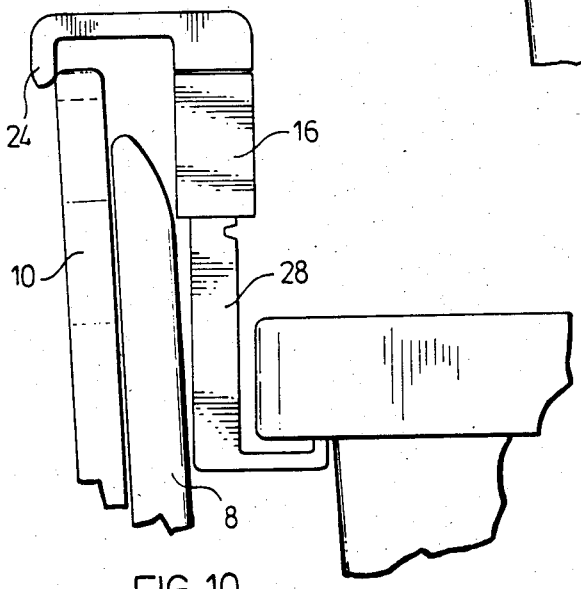

FIG. 9 shows the toilet seat 8 being trapped between the toilet seat 10 and the upright 28 as the toilet seat 10 is caming past the projection 24 causing a slight lifting or upward deflection of the hook 20 indicated by arrow 38. Once the seat 10 has moved past the projection 24, it will be held therebehind as generally indicated in FIG. 10. In some cases, it may be necessary to adjust the position of the hook to assure this action accurs and this is accomplished by adjusting the position of the collar 16 relative to the upright 28 as indicated in FIG. 8 and FIG. 2.

Figure 11:
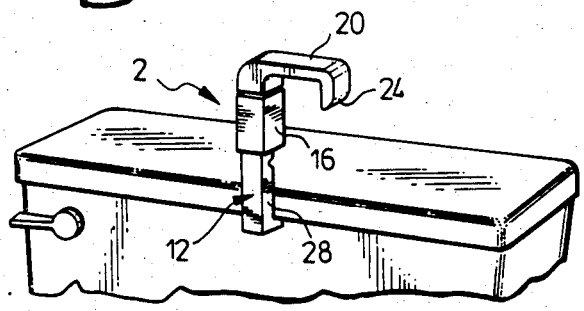
FIG. 11 is a partial perspective view of the toilet hook in the non-use position.

FIG. 11 shows the toilet hook apparatus in the non-use position as the hook 28 has been rotated about the upright 28 so that it does not engage the toilet seat 10 when moved to the vertical position. This position may be preferred to accomodate different users of the toilet as they may tend to sit thereon in a vertical or slightly rearwardly extending posture where the hook would uncomfortably engage the back of the person. By rotating the hook to the non-use position, the problem is overcome.

Figure 15:
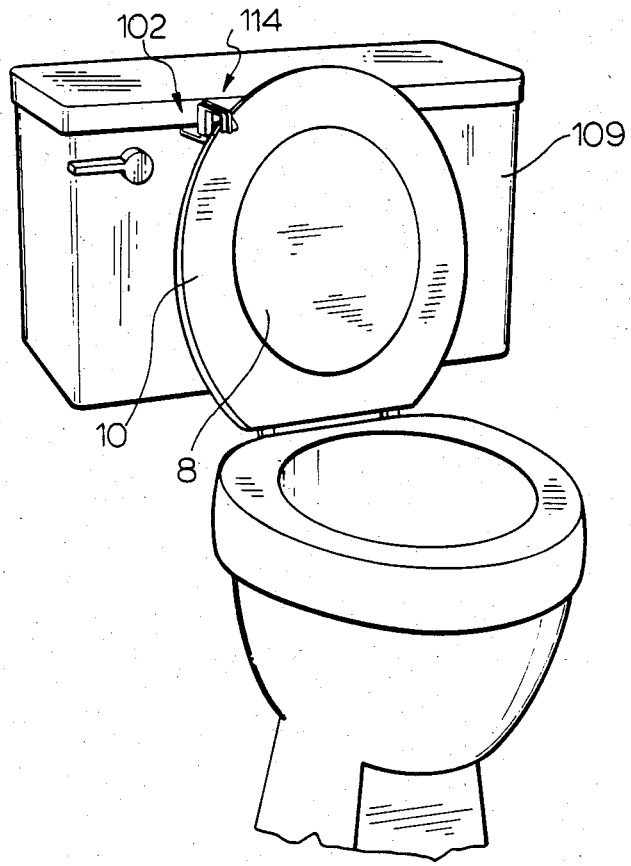
FIG. 15 is a partial perspective view of the toilet hook secured to a toilet tank and engaging a toilet seat.
Figure 16:
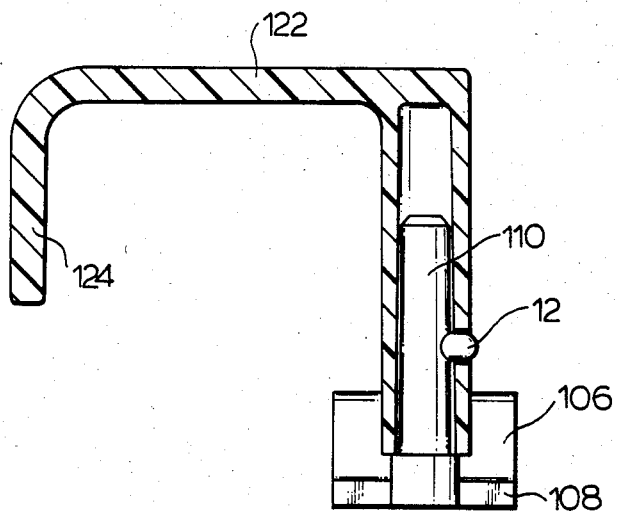
FIG. 16 is a sectional view through a toilet hook of FIG. 12 in the non-engaging position.

A variation of the toilet seat engaging apparatus generally shown as 102 in FIG. 12 does not allow for vertical adjustability, but is adapted to contact an edge region of the toilet seat. Because the structure of FIGS. 12 through 16 is different from the earlier figures, a new numbering scheme has been adopted. The toilet seat engaging apparatus 102, includes a securing base member 104, shaped to define a channel portion 106 for placement on the upper edge 107 of a toilet tank. Securing base 104 includes a forwardly extending flange 108 having a securing post 110 extending perpendicular thereto. The securing post includes a stop lug 112 which cooperates with various slots provided in the seat engaging member 114. The seat engaging member 114 includes a socket 116 for receiving post 110 and lug 112 of the base member, and includes a vertical slot 118 and a horizontal slot 120 which allow the seat engaging member to initially be inserted on the post and thereafter allow limited rotation thereof, relative to the securing base 104. The seat engaging member 114 includes a forwardly extending arm 122 which terminates in a downwardly extending arm 124 having a seat engaging lip 126. As shown in FIG. 12 and FIG. 15, the securing base 104 is placed on the upper edge 107 of the toilet tank 109 such that the "U" shaped portion straddles the tank walls and overlies a portion of the upper edge 107. The toilet tank lid will then be placed on the toilet tank 109 and will be positioned intermediate the securing post 110 and the channel portion 106. The slight additional spacing of the lid above the toilet tank 109 due to the thickness of the channel portion 106 will not be noticeable or effect the operation of the toilet.

Figure 13:
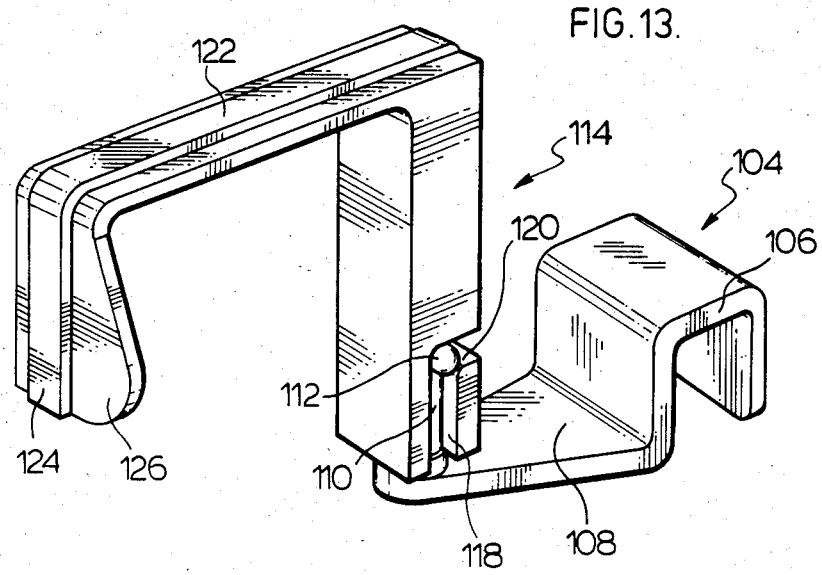
FIG. 13 is a perspective view of the toilet hook of FIG. 12 in the seat engaging position.
Figure 14:
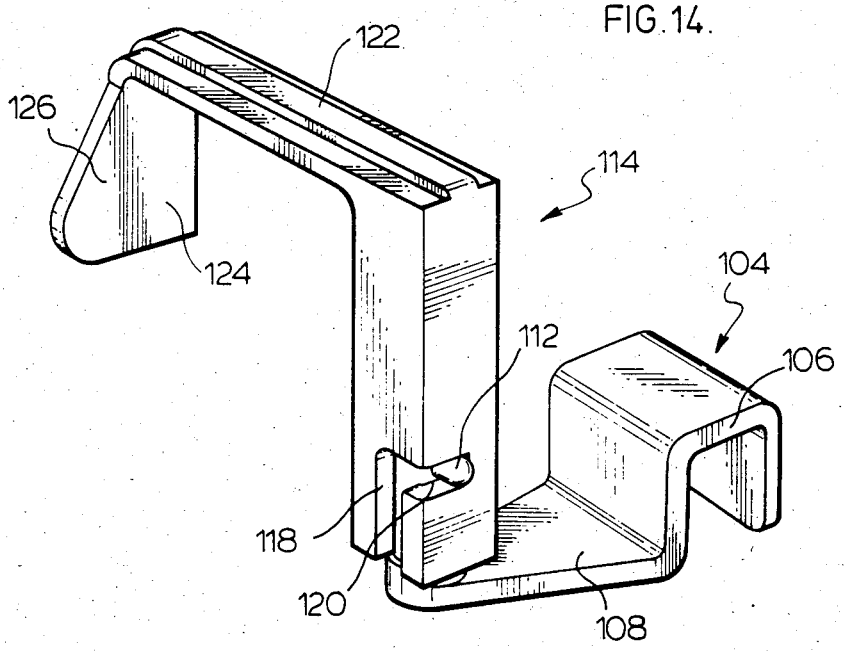
FIG. 14 is a perspective view of the toilet hook of FIG. 12 in a non-engaging position.

FIG. 13 shows the toilet seat engaging apparatus 102 in its operative position with the seat engaging lip 126 generally aligned with the securing post and the channel portion 106. In this position, such as that shown in FIG. 15, the lip engaging portion 126 will engage the toilet seat and maintain it in the vertical position trapped between the toilet tank and the engaging lip 126. Therefore, if the toilet seat includes an additional cover member, the thickness thereof will effect the end position of the toilet seat and there is a tendency for this toilet seat to again return to the horizontal position. This problem is overcome by properly positioning the seat engaging member to positively retain the toilet seat in the generally vertical position. In cases where it is desireable to return the toilet seat to the horizontal position, the seat engaging member may be pivoted on post 112 and rotated to the inoperative position, generally shown in FIG. 14. The stop lug 114 engages the end of the slot 120 and thereby limits the extent of rotation. The vertical slot 118 also contacts the stop lug to serve as a stop mechanism for determining the actuating position. This arrangement is shown in FIG. 13.

In contrast to the structure of FIGS. 1 through 11, the device shown in FIGS. 12 through 16 will be positioned on a toilet tank at the correct horizontal position, such that the lip engaging portion 126 when moved to the operative position will positively retain a generally vertically disposed toilet seat, such as that shown in FIG. 15. Toilet tanks and toilets in general vary considerably and the dimensions thereof can change as well as the actual shape of the toilet lid and toilet seat. The structure of FIGS. 12 through 16 accommodates these widely varying designs in a simple manner by the appropriate placement of the base member on the upper edge of the toilet tank. It can also be appreciated that under the proper circumstances, the arrangement of FIGS. 12 through 16 could engage the upper edge of the toilet seat if an appropriate relationship between the toilet tank and toilet seat was encountered. Therefore, the structure of FIGS. 12 through 16 sometimes can operate in the manner of FIGS. 1 through 11 where the sizing of the tank and the toilet set is such that vertical adjustment of the hook engaging portion relative to the base is not required.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. Apparatus for releasably maintaining a toilet seat in a generally vertical position comprising mounting means for securing said apparatus to a toilet and means for selectively contacting and maintaining such toilet seat in the vertical position and wherein said mounting means includes a channel means for engaging either side and the top edge of a toilet tank wall with an upright portion to one side of said channel means for adjustably receiving and engaging said selective means, said selective means including a collar portion one end of which is adapted for adjustable connection with said upright portion and the other end adapted to allow horizontal rotation of said selective means about said upright portion, said selective means including a forwardly extending arm at the end opposite said collar portion having a cam surface for contacting a toilet seat which moves there past by resilently bending said arm, said arm returning to a position to cause said cam surface to engage such seat and maintain the same between said cam surface and said collar unless acted upon by a non gravitational force urging such seat towards a horizontal position.

2. Apparatus for engaging a toilet seat comprising a mounting bracket having a channel for engaging either side of and the upper edge of the wall of a toilet tank and an upright member proud of said channel for extending above such tank adjacent the tank cover, seat engaging means having a securing portion telescopically associated with said upright member for adjusting the spacing of said seat engaging means from said channel and an arm means extending at an angle to said securing portion having free end thereof adapted for camming with a toilet seat as it is moved to a vertical position and holding said seat in the vertical position until acted upon by a non gravitational force sufficient to resiliently bend said arm means and allow such seat to move therepast.

3. A toilet accessory comprising a base and a seat engaging member supported by said base, said base including a channel portion sized to snuggly straddle and overlie an upper edge of a toilet tank wall with said seat engaging member forward of such toilet tank wall for engaging and restraining a toilet seat when moved to a generally vertical position;

said seat engaging member cooperating with said base to restrain such intermediate such tank and at least a portion of said seat engaging member when so positioned and providing for release of such seat to a horizontal position, said seat engaging member including a socket which receives a securing post of said base member to define therebetween a pivot connection, to accommodate movement of said seat engaging member for a seat restraining position to a seat release position.

4. A toilet accessory as claimed in claim 3, wherein said securing post includes a stop lug projecting radially outward and said socket includes slots for initially allowing said socket to slide over said post and thereafter define a stop mechanism with said lug limiting movement of said engaging member between a engaging position and a clear position.

5. A toilet accessory as claimed in claim 4, wherein said seat engaging portion is "U" shaped and of a width to accommodate the thickness of a toilet lid and a toilet lid therebetween.

6. Apparatus for engaging a toilet seat comprising a mounting bracket having a channel sized to engage either side of the upper edge of the wall of a toilet tank, said mounting bracket forward of said channel a distance sufficient to accommodate the lip of a toilet tank lid having an upright post for pivotal cooperation with seat engaging member, said seat engaging member including a socket into which said post is received with said seat engaging member being pivotal about said post for movement from a toilet seat engaging position to a toilet seat release position, said seat engaging member including an extension cantilevered relative to the upright post and having an end configuration for engaging the peripheral portion of a toilet seat for restraining the same when the seat is in the vertical position and the seat engaging member is in the seat engaging position.

7. Apparatus as claimed in claim 6, wherein said socket includes a slot opening for accommodating a stop lug projecting radially outwardly of said post, said stop lug and said slot opening cooperating to define the seat engaging position and said release position with said stop lug in abutment with and limited by a peripheral portion of said slot opening with said slot opening accommodating movement of said seat engaging member between the release position and said seat engaging position.

8. Apparatus as claimed in claim 6, wherein said seat engaging member is of an inverted generally "U" shaped configuration and of a width to accommodate the thickness of a toilet lid and toilet seat therebetween, said post including a stop lug which cooperates with a slot configuration opening into said socket, said slot configuration and stop lug collectively defining the extent of pivotal movement of said seat engaging member about said post.

* * * * *